United States Patent [19]

Hudson

[11] 4,437,097

[45] Mar. 13, 1984

[54] BUOYANT ELECTRODE

[75] Inventor: John A. Hudson, Panama City, Fla.

[73] Assignee: The United States of America as represented by the Secretary of the Navy, Washington, D.C.

[21] Appl. No.: 342,251

[22] Filed: Jan. 25, 1982

[51] Int. Cl.[3] ..... B63B 21/56; H01B 7/12

[52] U.S. Cl. ..... 340/852; 174/101.5

[58] Field of Search ..... 340/852; 174/101.5

[56] References Cited

U.S. PATENT DOCUMENTS

| | | | |
|---|---|---|---|
| 2,549,777 | 4/1951 | Craig | 174/101.5 |
| 2,987,029 | 6/1961 | Manuel | 114/235 |
| 3,940,732 | 2/1976 | Hudson et al. | 340/852 |
| 4,116,153 | 9/1978 | Fisher et al. | 114/244 |
| 4,117,447 | 9/1978 | Gould et al. | 340/852 |

OTHER PUBLICATIONS

Standard Specification for Aluminum 1350–H19 Wire for Electrical Purposes Designation B230–77 of American Society for Testing & Materials, p. 299.

*Primary Examiner*—Richard A. Farley

*Attorney, Agent, or Firm*—Robert F. Beers; Harvey A. David

[57] ABSTRACT

A towable, flexible electrode for high density electrical current transfer to sea water is characterized structural improvements including use of hard drawn aluminum wire and a rotatable and slideable aft slip ring to avoid "bird caging", and towing and electrical connectors having a first portion fixed to the electrode and presenting a boss, and a lug portion having a body with a bore receiving the boss and pinned thereto. The electrode features an optional insulating tube for moving the effective length of the electrode rearwardly of a towing platform.

7 Claims, 7 Drawing Figures

BUOYANT ELECTRODE

BACKGROUND OF THE INVENTION

This invention relates to buoyant, towed electrodes of the cable type such as are used for sweeping of magnetic influence mines and more particularly to improved constructions therefor.

U.S. Pat. No. 3,940,732, issued to J. A. Hudson and M. J. Yelverton and assigned to the assignee hereof, describes a buoyant electrode of a cable type that is towed along its axial length, by a helicopter for example, at substantial speeds through sea water. The electrode is energized to produce electrical currents in the sea water. Magnetic disturbances resulting from the electrical currents and the forward motion of the electrode are effective in sweeping magnetic influence mines. The electrode of that patent comprises a core of central strength member in the form of a synthetic filament rope, a cylindrical buoyant sleeve of a closed cell plastic foam material and an outer conductive layer formed of helically wound strands of alunimum wire. The aluminum wire strands are tightly bound with an aluminum wire serving in the forward portion of the electrode, and the forward end of the electrode is provided with a conductive metal lug or connector that is swaged or otherwise fixed to the strength member and provides for electrical connection to the serving and to the helical wires of the electrode. At the aft end of the electrode, the helical wires are bound to the buoyant sleeve by one of more metal bands, preferably of the screw tightened variety.

Variations from the electrode described in that patent are disclosed in U.S. Pat. Nos. 4,117,447 and 4,185,264, which variations are principally directed to structures for alleviating or reducing the phenomena referred to as "birdcaging" which is characterized by a ballooning of the helically wound layer of soft-drawn aluminum wires at the aft end of the electrode. The approach of U.S. Pat. No. 4,117,447 requires an axially keyed, sliding member, while that of U.S. Pat. No. 4,185,264 requires towing or "preconditioning" of the electrode. Elimination of both would, of course, be desirable.

In all of the foregoing electrode cables, there is provided a terminal lug which serves both as the leading tow point and also as the electrical connection to the towing cable through which the electrically energizing current is applied. That lug has typically comprised a tubular portion that is compressively swaged over a cable anchor of the type comprising a tapered bore in which the strands of the strength member of the cable are splayed and potted and in part over a wire serving that binds the forward ends of the layer of aluminum electrode wires. Thus, the lug makes both mechanical and electrical connections. It has been found in practice that, it becomes necessary from time to time to replace the lug because of damage by electrolysis, mechanical fatigue, and the like. This replacement requires cutting the old lug and anchor off, trimming the electrode cable back, and applying a new anchor, serving, swaged lug, and rubber collar.

In one configuration of use for minesweeping purposes electrodes cables, which are made up in standard lengths of say 175 feet and diameters on the order of 5 inches, are streamed from a towing vehicle carrying D.C. generating means and various electronic instrumentation. One electrode serves as a cathode and is connected in a close-coupled manner relative to the vehicle by a short pigtail cable while a second electrode serves as an anode and is connected to the aft end of a long, insulated supply cable. In this configuration it has been found that the electromagnetic field generated by the forward end of the close-coupled cathode interferes with operation of the mentioned instrumentation. While increasing the length of or adding to the short pigtail cable to move the cathode rearwardly eliminates the interference problem, there are introduced considerable added logistics problems of handling, storage, and deployment due to the extra pigtail cable.

SUMMARY OF THE INVENTION

With the foreoging in mind, it is a principal object of this invention to provide an improved, buoyant, flexible electrode.

Another important object is to provide an improved electrode, of the type comprising an outer helically wound layer of aluminum wire, and which improved electrode is characterized by the wire of the outer layer being formed of hard-drawn aluminum wire, whereby migration of any slack in the layer toward the aft end, and consequent birdcaging, is substantially eliminated.

Still another object of the invention is the provision, in a cable of the foregoing character, of a terminal lug, at the forward end of the cable, that is readily removable and replaceable.

As yet another object, the invention aims to provide a buoyant electrode cable, the minesweeping or other purposes requiring generation of an electromagnetic field in the water, that is relatively inexpensive to manufacture and prepare for such use, and which requires little attention in the way of maintenance and/or repair.

A further object is the provision of an improved electrode that can be used either as the anode or as the cathode in the aforementioned configuration, and which, with a simple yet effective addition when used as the cathode, has the effect of having been spaced rearwardly of the vehicle by a distance that avoids the mentioned interference.

Other objects and advantages will be readily appreciated as the subject invention becomes better understood by reference to the following detailed description, when considered in conjunction with the accompanying drawings.

DESCRIPTION OF THE PREFERRED EMBODIMENT

Figure 1A:
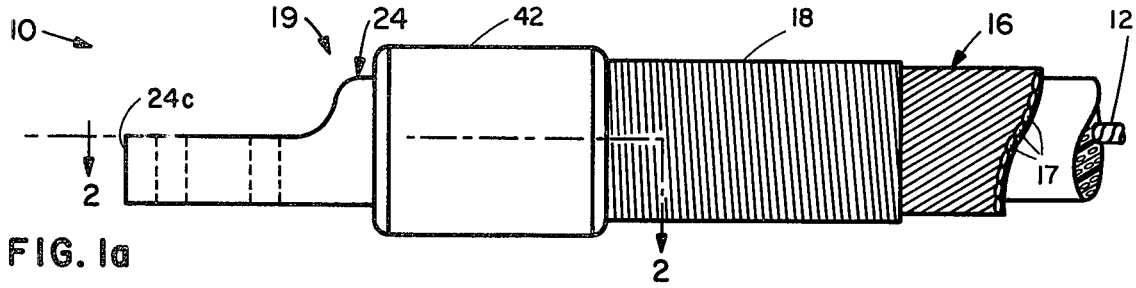
FIG. 1*a* is a side elevational view of the forward end portion of an electrode embodying this invention.
Figure 1B:
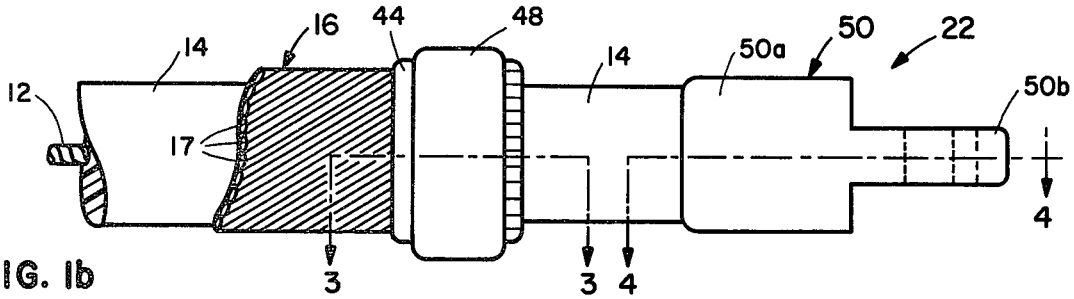
FIG. 1*b* is a side elevational view of the aft end portion of the electrode of FIG. 1*a;*

Referring to FIGS. 1*a* and 1*b*, a flexible, buoyant, cable type of electrode is indicated generally at 10 and comprises a central strength member 12, a cylindrical sleeve or core 14 of buoyant plastic material, such as molded, cellular polyethylene, surrounding the strength member, a layer 16 of helically laid aluminum wire strands 17, a wire serving 18, and a forward end connector generally indicated at 19. Additionally, the electrode 10 conveniently comprises an aft end connector or tow eye generally indicated at 22.

The electrode 10 of this invention differs from the prior electrodes described in the aforementioned patents in various respects including the constructions of the forward end connector 19, the electrically active layer 16 of aluminum wire strands 17, and the aft end termination of those strands, all as will be more fully described as this specification proceeds.

Figure 2:
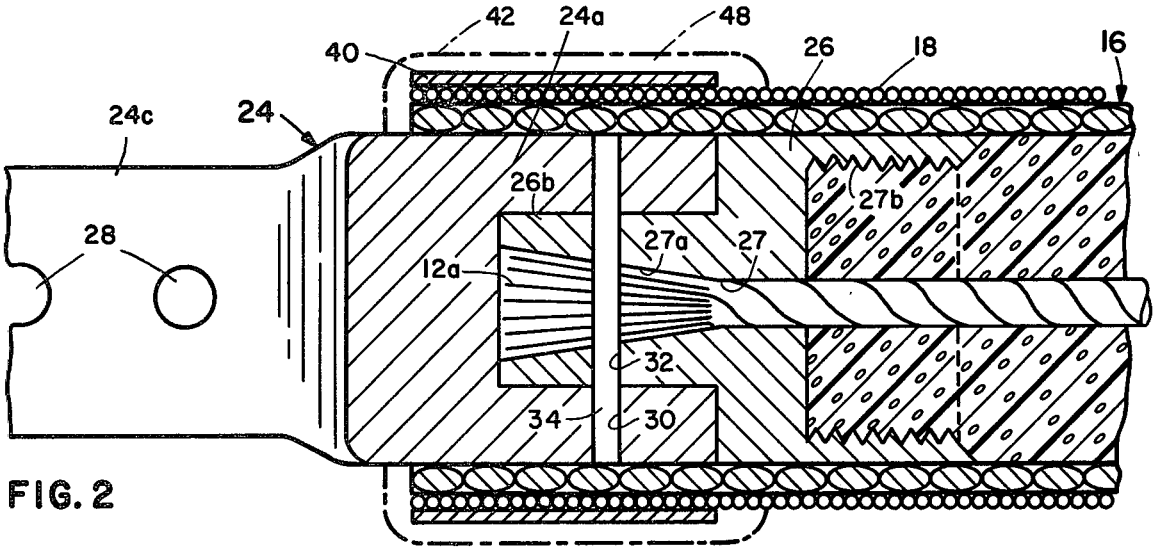
FIG. 2 is an enlarged, fragmentary sectional view taken substantially along line 2—2 of FIG. 1*a;*

Referring now to FIG. 2, the forward connector 19 comprises a lug member 24 and an anchor member 26. The lug member 24, which is formed of a conductive material such as aluminum, includes a cylindrical body portion 24*a*, having an axial bore 24*b*, and an offset blade portion 24*c* having apertures 28. The anchor member 26 includes a cylindrical body portion 26*a*, and an axial boss or cylindrical insert portion 26*b* adapted to be snugly received in the bore 24*b* of the lug member 24. The anchor member 26, which may be formed of a rigid plastic or metal, further has an axial passage 27 including a tapered portion 27*a* in which the splayed strand ends 12*a* of the strength member 12 are potted, and an internally threaded counterbore portion 27*b* in which the end of the buoyant sleeve 14 is threadedly engaged by screwing the anchor member body portion thereon during assembly and prior to potting of the strength member in the tapered bore. It will be understood that the strength member 12 comprises a rope made of a suitable metal, synthetic, or natural fiber, and that the potting material (not shown) is selected accordingly from fusible metals, epoxy, or the like. In the preferred embodiment the member 12 is a non-metallic synthetic such as nylon, polyester, or aramid fiber.

The body portion 24*a* of the lug member and the insert portion 26*b* of the anchor member have transverse bores 30, 32, respectively, that are aligned or drilled during assembly to receive a through pin 34 that is inserted to secure the lug member in place on the anchor member after the potting operation. The screwing of the anchor member 26 onto the molded buoyant core 14, makes the latter an effective longitudinal strength producing component of the electrode structure so that, together with the central strength member and its splayed and potted termination, the resulting connection will remain reliable in spite of prolonged stress and vibration when towed at high speeds.

The aluminum wires 17 of the conductive, helically wound layer 16 are, according to one important feature of this invention, formed of hard-drawn wire in distinction to the prior known electrodes wherein relatively soft wire has been used. The preferred wire for this embodiment is in accordance with the Standard Specification for ALUMINUM 1350-H19 WIRE FOR ELECTRICAL PURPOSES issued under the ASTM (American Society for Testing and Materials) Designation B230-77. It has been found that the use of the hard-drawn wire strands 17, the term hard-drawn being used herein to mean aluminum wire substantially meeting the mentioned standard specification, results in considerably less creep, unwinding stretch, or other factors tending to create an accumulation of excess wire in a "birdcage" at the aft end of the electrode, and that provision for axially keying of a sliding member at the aft end to prevent unwinding can be eliminated.

As shown in FIG. 2, the layer 16 extends forwardly over the anchor member 26 and the body portion 24*a* of the lug member 24. The serving 18, which is formed of aluminum wire that is conveniently of a smaller diameter or gauge than the wires 17, extends forwardly over the layer 16 and is coterminus therewith. The serving 18 and electrode wire layer 16 are securely clamped to the body portion 24*a* of the lug member 24 by a metal ring or sleeve 40 that has been constrictively pressed. This construction assures good electrical connection between the lug member, the conductive layer 16 and the serving 18. A molded rubber or other suitable, rubber-like, electrically insulative, plastic collar 42 is formed about the pressed sleeve 40, as shown in phantom in FIG. 2. The exposed portion of the serving 18, which extends rearwardly for several feet or more, serves as sacrificial material when the electrode 10 is used as an anode so that damage to the layer 16 will be minimized adjacent the forward connector 19.

Figure 3:
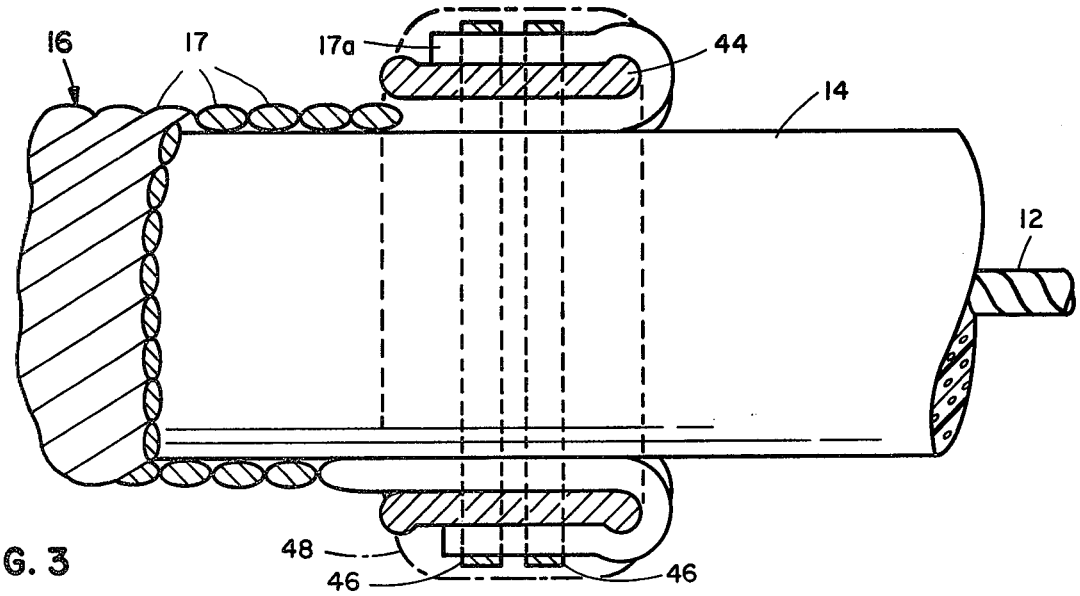
FIG. 3 is an enlarged, fragmentary sectional view taken substantially along line 3—3 of FIG. 1*b;*

Near the aft end, as is best seen in FIGS. 1*b* and 3, the layer 16 is fixed to a metal or rigid plastic ring 44 that surrounds the layer 16 with the ends 17*a* of wires 17 bent forwardly over the ring and fixed by one or more steel bands 46. The inner diameter of ring 44 is large enough to permit the layer 16 and the ring to slide on the core 14. A layer of rubber tape, shown in phantom at 48 conveniently provides a smooth, non-snagging finish. It will be noted that the layer 16 terminates short of the tow eye connector 22 and that a short amount of the core 14 is exposed. This permits the aft end of the layer 16, and the ring 44 to slide rearwardly, if necessary, with working of the electrode. As noted earlier, however, the use of hard-drawn wire will minimize such migration and, because of its stiffness, effectively prevents the formation of a "birdcage".

Figure 4:
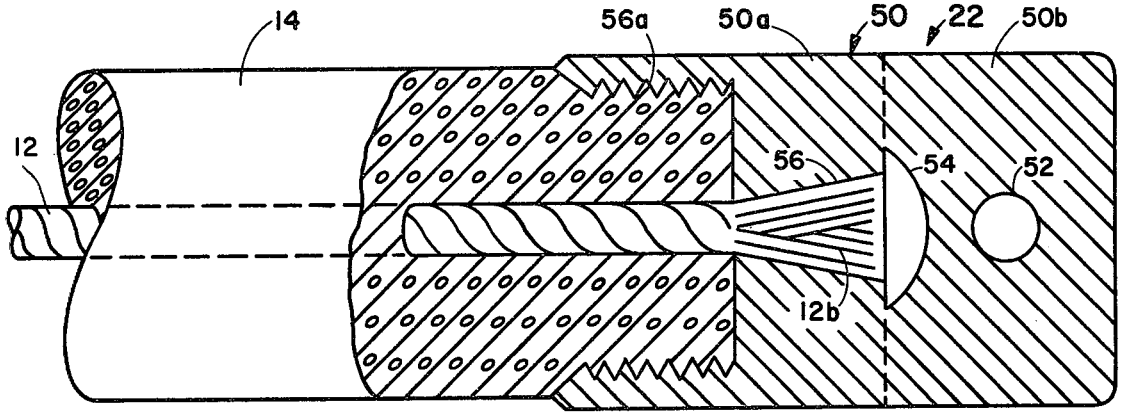
FIG. 4 is an enlarged, fragmentary sectional view taken substantially along line 4—4 of FIG. 1*b;*

Referring now to FIGS. 1*b* and 4, the aft end connector 22 comprises an eye member 50 having a cylindrical body portion 50*a* from which an axially extending eye portion 50*b* extends. The latter is provided with an aperture 52 for use in handling, towing other instruments, or the like, and a cut-out 54 for access to a tapered bore 56 in which the splayed end 12*b* of the strength member 12 is potted. The eye member 50 has an internally threaded counterbore 56*a* and is screwed onto the aft end of the buoyant core 14 prior to potting of the strength member so as to provide a particularly rugged and reliable terminal fitting.

Figure 5:
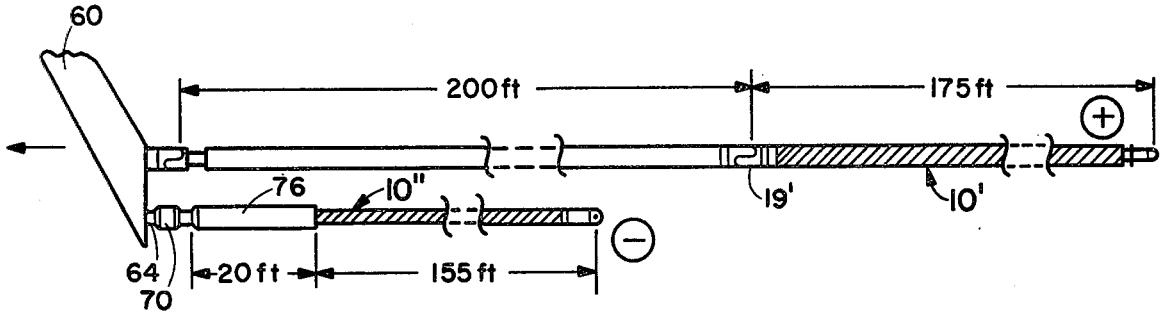
FIG. 5 is a side elevational view illustrating electrodes embodying the invention in an exemplary towed configuration.
Figure 6:
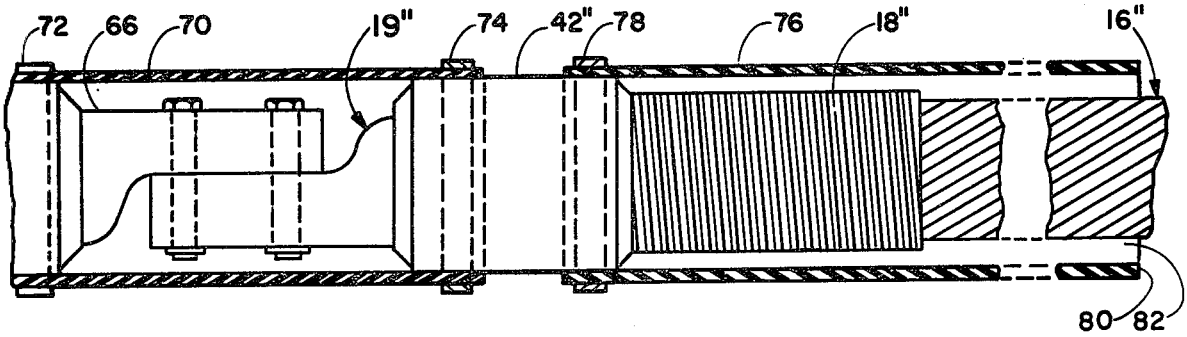
FIG. 6 is a fragmentary sectional view illustrating a modified embodiment of an electrode according to the invention.

Referring to FIG. 5, there is illustrated a towing configuration for two electrodes 10' and 10'' of the foregoing construction and serving as an electrical anode and cathode, respectively, each having a length of, say, 175 feet. A towing boom or strut 60 depends from a towing vehicle (not shown) into the water and has streamed therefrom a first, long, insulated cable 62 of length L that is connected to the forward connector 19' of electrode 10'. The cable 62 provides direct current electrical power to the electrode 10'. A close-coupled pigtail connector cable 64, carried by the strut 60 has a connector fitting 66 connected or bolted as shown in FIG. 6 to the forward connector 19'' of the electrode 10''. A short section of flexible rubber tube 70 is secured by clamps 72, 74 to the rubber collars 66*a* of the supply cable connector 66 and 42″ of the electrode to insulate the connection. A longer section of flexible rubber tube 76 is fixed at its forward end by a clamp 78 to the rubber collar 42″. The tube 76, which in this example is 20 feet long, is open at its aft end 80 so as to allow free flooding of the space 82 between the tube and the electrode layer 16″. The tube 76, serves as an insulating sleeve or shield that effectively shortens the electrode 10″ by moving the forward end of the free water-to-electrode current path back to the end 80 of the tube. Accordingly, the electromagnetic field is moved away from the towing vehicle and the instrumentation carried thereby.

Obviously, other embodiments and modifications of the subject invention will readily come to the mind of one skilled in the art having the benefit of the teachings presented in the foregoing description and the drawing. It is, therefore, to be understood that this invention is not to be limited thereto and that said modifications and embodiments are intended to be included within the scope of the appended claims.

What is claimed is:

1. A buoyant electrode of the type comprising a buoyant core, includng a central strength member surrounded by cellular plastic flotation material, a conductive layer of helically laid strands of wire formed around said core, and a forward end connection for towing said electrode and for electrically energizing said conductive layer, said electrode being characterized by the improvement comprising:

said wire strands being formed of hard drawn aluminum; and annular clamping means for fixing together the aft ends of said wire strands for combined rotational and sliding movement of said aft ends relative to said core.

2. A buoyant electrode as defined in claim 1, and further characterized by the improvement wherein said forward connector comprises:

an anchor member fixed to said core and having a first cylindrical body portion of substantially the same diameter as said core, and a reduced diameter boss portion extending axially forwardly of said first body portion;

a lug member comprising a second cylindrical body portion having an axial bore snugly receiving said boss portion; and a transverse fastening member fixing said second body portion on said boss portion.

3. A buoyant electrode as defined in claim 2, and wherein:

said first and second cylindrical body portions are of substantially the same diameter and abut one another; and said conductive layer extends forwardly over said first and second body portions.

4. A buoyant electrode as defined in claim 3, and further comprising:

a wire serving layer formed over the forward end portion of said conductive layer; and a cylindrical metal sleeve compressively clamping said serving layer and said conductive layer to said first and second cylindrical body portions.

5. A buoyant electrode as defined in claim 4, and further comprising:

a collar of electrically insulative material formed over said metal sleeve.

6. An electrode as defined in claim 5, and further comprising:

an elongated flexible tube of electrically insulative material having its forward end clamped to said collar and extending rearwardly over said electrode for a predetermined distance, said tube having an inside diameter that is larger than the outside diameter of said conductive layer so as to define a space therebetween. and the aft end of said tube being open for free flooding of said space.

7. An electrode as defined in claim 6 in combination with a current supplying cable having a supply connector fixed in conductive, towing relation to said forward connector of said electrode, and further comprising means for electrically insulating said supply and forward connectors from ambient water.

* * * * *